US005453209A

United States Patent [19]

Simon

[11] Patent Number: 5,453,209

[45] Date of Patent: Sep. 26, 1995

[54] CHEMICAL METAL AND OIL TREATING COMPOSITION AND PROCESS

[76] Inventor: Juanito A. Simon, 554 Calvados Ave., Covina, Calif. 91723

[21] Appl. No.: 952,377

[22] Filed: Sep. 28, 1992

Related U.S. Application Data

[63] Continuation-in-part of Ser. No. 756,688, Sep. 9, 1991, abandoned.

[51] Int. Cl.[6] ..... C10M 125/00

[52] U.S. Cl. ..... 252/18; 252/22; 252/23; 252/25; 252/29; 252/30; 252/32.7 E; 252/33.3; 252/45; 252/49.9; 252/51.5 A; 252/51.5 R; 252/58

[58] Field of Search ..... 252/30, 25, 29, 252/18, 22, 23, 33, 33.3, 32.7, 51.5 R, 51.5 A, 49.9, 45, 58

[56] References Cited

U.S. PATENT DOCUMENTS

| | | | |
|---|---|---|---|
| 802,377 | 8/1905 | Ekert | 252/30 |
| 2,466,927 | 4/1949 | Burton | 252/30 |
| 2,658,869 | 11/1953 | Stross et al. | 252/28 |
| 2,671,758 | 3/1954 | Vinograd | 252/25 |
| 2,748,081 | 5/1956 | Peterson | 252/25 |
| 2,751,352 | 6/1956 | Bondi | 252/25 |
| 2,757,138 | 7/1956 | Clatot | 252/30 |
| 2,968,617 | 1/1961 | Reykjalin | 252/30 |
| 3,047,507 | 7/1962 | Winslow | 252/75 |
| 3,047,526 | 7/1962 | Stephens | 252/25 |
| 3,277,001 | 10/1966 | Fischer et al. | 252/32.5 |
| 5,137,980 | 8/1992 | DeGonia | 525/327.6 |

*Primary Examiner*—Margaret Medley
*Attorney, Agent, or Firm*—John J. Posta, Jr.

[57] ABSTRACT

This invention is directed to a liquid metal and oil teating composition and to the process of preparing the composition. In the process there are first mixed together a vegetable oil such as cashew oil, an oleate ester such as magnesium oleate, and Ingredient A which is material selected from the group consisting of powdered ferric chloride, lead oxide, ferric oxide, iron carbide, chromium carbide and tungsten carbide and mixtures thereof dispersed in an aqueous solution of acid selected from the group consisting of hydrochloric acid, perchloric acid and sulfuric acid. The acid solution is concentrated, preferably containing about 40 volume % acid. The mixture is heated and stirred and then distilled. The residue is then heated to about 100°–150° F. while adding to it, with stirring, an antioxidant, a polar hydrocarbon, a carbonyl, a carboxyl amide, a viscosity improver, at least one of a tackifier and a sulfonate, and a petroleum oil until a homogeneous liquid is obtained.

11 Claims, 2 Drawing Sheets

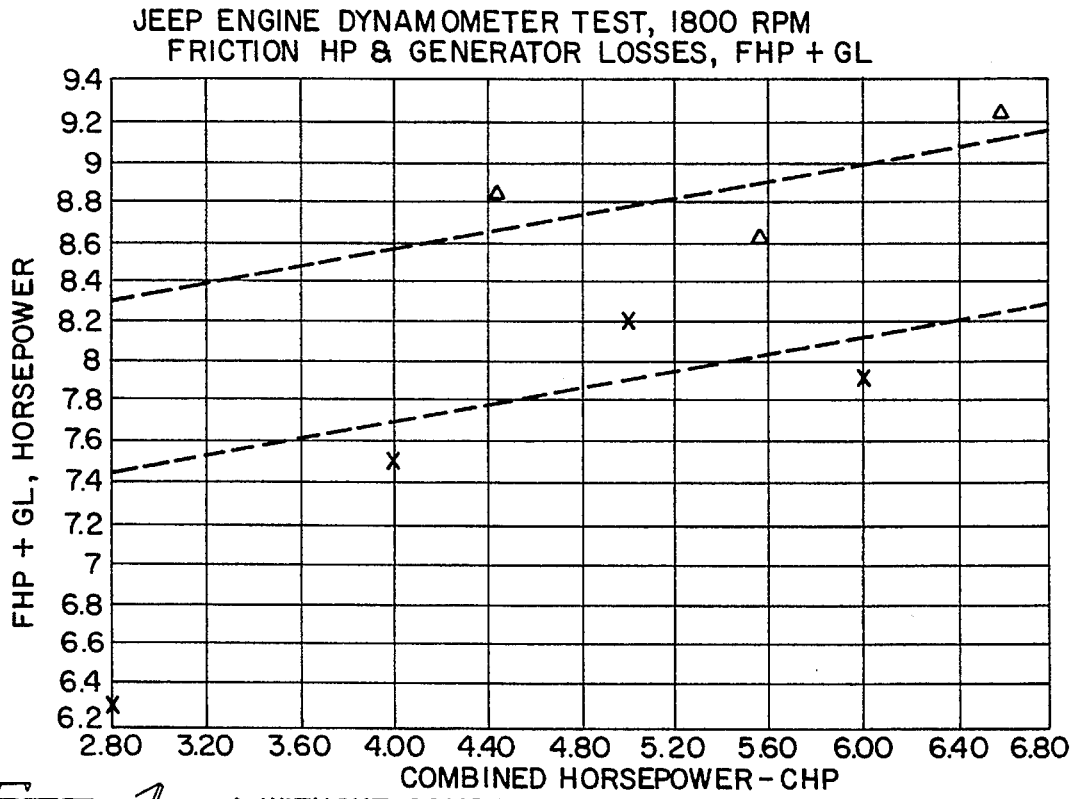
FIG. 1 Δ-WITHOUT COMPOSITION X-WITH COMPOSITION
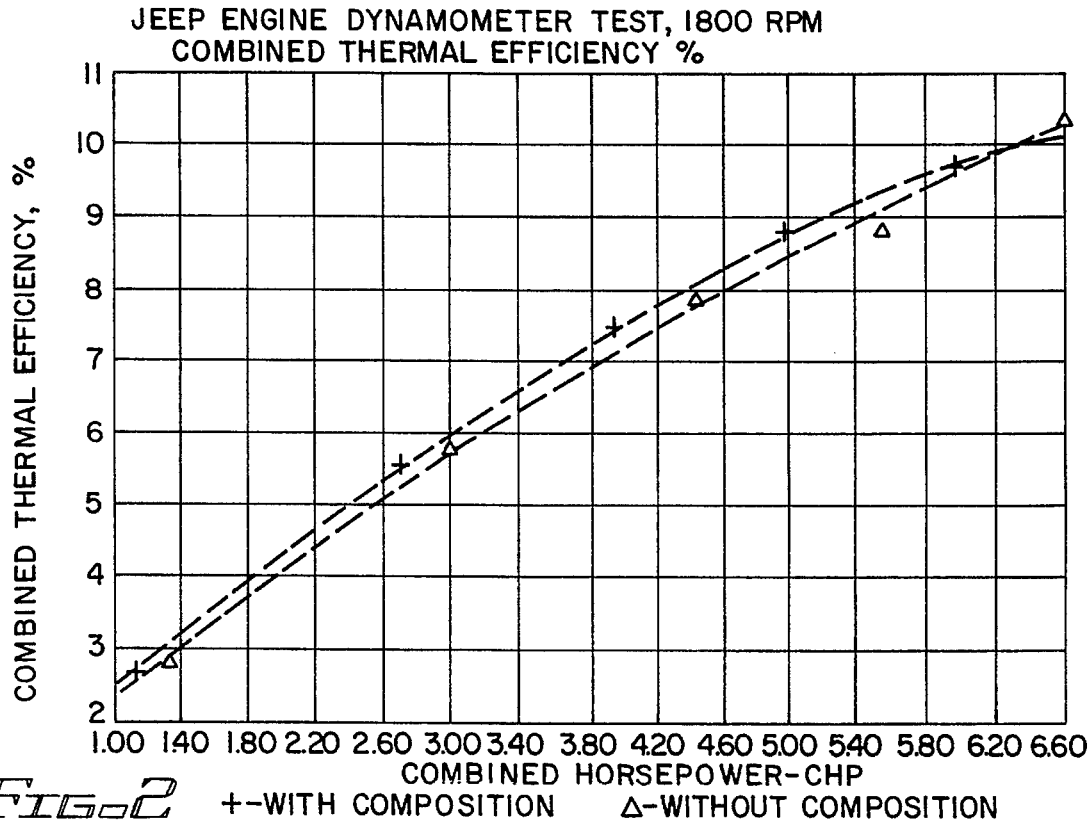
FIG. 2 +-WITH COMPOSITION Δ-WITHOUT COMPOSITION

CHEMICAL METAL AND OIL TREATING COMPOSITION AND PROCESS

CONTINUATION-IN-PART

This is a Continuation-In-Part of application Ser. No. 07/756,688 filed Sep. 9, 1991 now abandoned.

BACKGROUND OF THE INVENTION

1. Field of the Invention

This invention generally relates to metal treating compositions and more particularly to a composition which largely nullifies friction in any machine engine or equipment, by acting as cushion, shield or barrier between metallic surfaces and by reducing the molecular exchange created by friction, thereby preventing the formation of intermetallic junctions which develop between different metal surfaces. Intermetallic junctions are the microscopic essence of friction and wear. They are microscopic physical barriers caused by the exchange of molecules between two metal surfaces having different surface energies. The process by which the composition is made also forms part of the invention.

2. Prior Art & Description

In designing a machine, engine or equipment, engineers normally consider the presence of frictional resistance in terms of friction losses or friction horsepower. Dragging friction resists the output power efficiency of the mechanism, damages the physical properties of the metal components by means of wear and tear. To minimize friction the common method used is lubrication or the introduction of an oil film to create a "gap" between all mating surfaces, thus reducing static build-up causing wear and tear.

This invention, a breakthrough in engine friction prevention and lubrication technology, has been developed to: 1) nullify friction, 2) convert contaminants such as water and corrosives into lubricants; 3) bind water and oil; 4) dissolve and hold contaminants in suspension; 5) impart new characteristics to lubricating oils by increasing film strength, lubricity and stability (as a result, these lubricating oils perform far better since there is a higher resistance to thermal, viscosity and chemical breakdown. Therefore, all lubricating oils last significantly longer.); and 6) protect metal against the tremendous impact of wind and water such as is encountered by space ships, airplanes and oceanliners.

The use of the present composition has various consequential benefits and applications such as: 1) providing a marked reduction of wear and tear of the mating surfaces of engines, machines and other equipment, thereby reducing downtime costs, 2) inhibiting the formation of carbon, gums and lacquer deposits on metal parts; 3) facilitating easy starting of an engine, machine or other equipment, even at subzero or high temperatures; 4) reducing the environmental emission of harmful acids and gases such as carbon monoxide and hydrocarbons; 5) exhibiting extreme resistance to deterioration at low and high temperatures; 6) enabling a machine to achieve optimum capacity because the usual frictional losses that reduce the performance of the machine are converted into additional power output; and 7) enhancing the mechanical efficiency of an engine making it consume less fuel and oil, improving its performance, prolonging its life, and reducing noise and vibration from the machine or engine.

Since this composition adheres to metal surfaces on a molecular level, its lubricity becomes an integral part of metal surface structures without affecting engineered tolerances. Metal surfaces are, therefore, always protected even when engines/machines are first started, and during warm-ups.

One example of how the composition nullifies friction is the incompatibility of carboxyl amide and castor oil, for example, with other ingredients in the composition. These ingredients serve as an active "cushion" between two mating surfaces, thereby preventing metal-to-metal contact. Polarity also plays a role in this action.

This invention also helps to reduce the soaring prices of fuel and lubricants, thereby resulting in a reduction in the cost of producing in-put electricity and in the expenditure of fuel such as gasoline and diesel fuel. The need for the manufacture and use of spare parts, equipment, machineries, hardwares, etc., and other manufacturing costs for industrial products is correspondingly reduced.

SUMMARY OF THE INVENTION

The object of this invention, therefore, is to provide a metal-treating composition which will nullify friction by means of its capability to become an integral part of the metal without disturbing the engineered clearances, thus eliminating the microscopic pores found in all metal surfaces of engines, machines and equipment, and which also serves as an intermetallic junction preventative.

Another object of this invention is to provide a composition which inhibits the formation of carbon deposits, due to the compositions' strong bond to metals and its ability to dissolve carbon particles. Another object is to provide a composition which dissolves gradually the gums and carbon deposits in an engine, thereby removing the carbon and gum deposits, such composition also serving as a cleansing agent for old engines as well as preventing the build-up, and inhibiting the formation of carbon, gums, rust, varnish and lacquer deposits on new and old engines.

A still further object of this invention is to provide a composition which increases the mechanical efficiency of an engine, machine, or equipment and makes it consume less fuel and oil, and reduces operating temperatures, thereby improving overall performance and prolonging the life of the engine or machine.

Other objects and advantages of the present invention will become apparent from the reading of the description which will hereinafter be discussed.

DRAWINGS

FIG. 1 is a graphical plot of friction horsepower and generator losses (FHP+GL) against CHP (combined horsepower) for separate runs with and without the use of the present metal treatment composition;

FIG. 2 is a graphical plot of combined thermal efficiency against combined horsepower (CHP) for runs with and without the use of the present metal treatment composition;

DETAILED DESCRIPTION OF THE INVENTION

Figure 3:
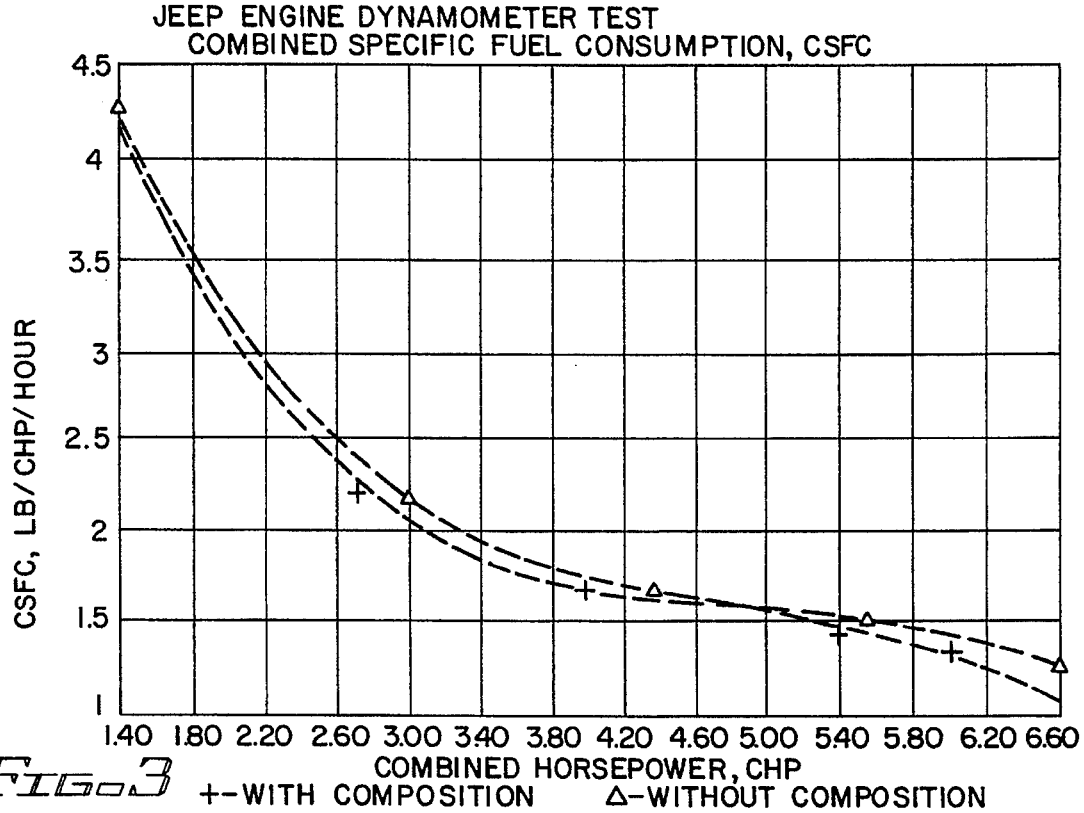
FIG. 3 is a graphical plot of combined specific fuel consumption (CSFC) in terms of LB/CHP/HR compared to combined horsepower (CHP) for runs with and without the use of the present metal treatment composition; and, FIG. 4 is a graphical plot of percentage of fuel savings based on combined horsepower (CHP) with the use of the metal treatment composition.
Figure 4:
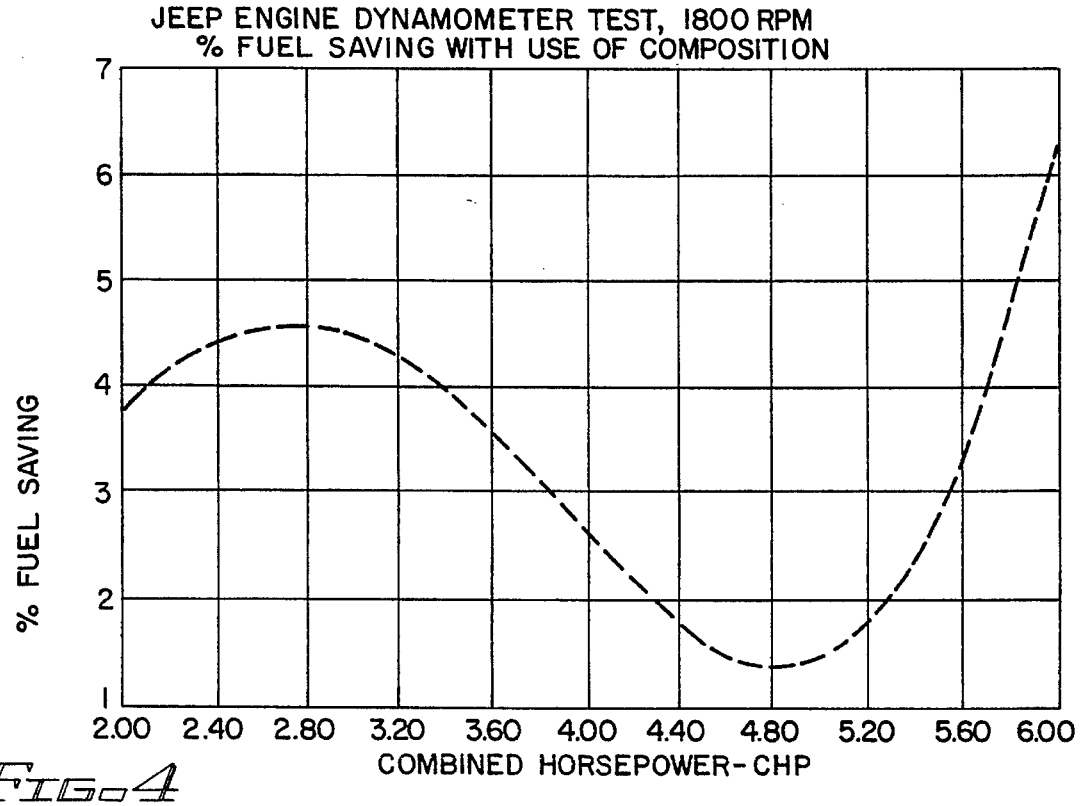

This involves an improved process of preparing a liquid metal and oil treating composition and the product of the process. The process is carried out by:

A) mixing together:

i. Ingredient A which comprises material selected from the group consisting of powdered ferric chloride, lead oxide, ferric oxide, iron carbide, chromium carbide and tungsten carbide and mixtures thereof, wherein said chloride, oxides and carbides are dispersed in an aqueous solution of acid selected from the group consisting of hydrochloric acid, perchloric acid and sulfuric acid (the acid preferably being in a concentration of about 40 percent by volume of the water);

i.i. vegetable oil; and, i.i.i. oleate selected from the group consisting of magnesium oleate, ethyl oleate and mixtures thereof;

B) Heating the resultant mixture with stirring to a temperature of at least about 100° F. to blend the components of the mixture together;

C) Distilling the heated mixture and recovering the non-distilled residue; and,

D) Subjecting said residue to stirring and heating at about 100°–150° F. while adding thereto an antioxidant, a polar hydrocarbon, a carbonyl, a carboxyl amide, a viscosity improver, at least one of a tackifier and a sulfonate, and a petroleum oil until a homogeneous liquid is obtained. The powdered material of Ingredient A is preferably about 0.2–0.3 micron in average diameter.

In the process, the aforesaid materials are used in the following approximate proportions:

COMPOSITION I

| MATERIALS | PERCENT BY VOLUME OF THE COMPOSITION |
|---|---|
| Ingredient A | 0.5–1.5 |
| Vegetable Oil | 0.5–1.5 |
| Oleate | 0.5–1.5 |
| Polar Hydrocarbon | 10.0–20.0 |
| Antioxidant | 0.5–2.0 |
| Carbonyl | 0.2–1.0 |
| Carboxyl Amide | 0.2–1.0 |
| Viscosity Improver | 25.0–40.0 |
| Tackifier | 0.5–2.0 |
| Sulfonate | 0.5–3.0 |
| Petroleum Oil | 40.0–60.0 |

In the improved process, the vegetable oil is at least one of castor oil, cashew oil and olive oil, the oleate is at least one of magnesium oleate and ethyl oleate, the polar hydrocarbon is at least one of chlorine-substituted hydrocarbon, bromine-substituted hydrocarbon and fluorine-substituted hydrocarbon, preferably, monochlorotoluene, monofluorobenzene, or monobromoxylene. The antioxidant is at least one of zinc dialkyl dithiophosphate, monochlorotoluene, nonyl phenol disulfide, 2, 6-di-tert-butyldimethylamino-p-cresol, 2,2' ethylidene Bis (4,6-di-t-butylphenyl) fluorophosphonite, 1,2,5-trimethyl 2-4-6 tris-(3,5)di-tert-butyl-4 hydroxybenzyl) benzene and 4,4 methylenebis (2,6 di-tert butylphenol), and the carbonyl is at least one of manganese carbonyl, nickel carbonyl, carbonyl chloride, carbonyl bromide, carbonyl fluoride and carbonyl sulfide.

In the improved process, the carboxyl amide is at least one of N,N' ethylene bisoleamide, N,N' ethylene bisstearamide, amide of benzoic acid, amide of alicyclic acid, amide of chloroacetic acid and amide of salicylic acid, the viscosity improver is at least one of an alkyl ester, or a powdered polyisobutylene, olefin copolymer, neoprene resin and/or (about 0.02–0.4 micron diameter) material which is polychloroprene. The tackifier is at least one of polyisobutylene and polybutene. The sulfonate is at least one of magnesium sulfonate, calcium sulfonate and alkyl benezene sulfonate and the petroleum oil is at least one of naphthenic oil and heat transfer oil which means a medium used for the transfer of heat at high temperature levels. This medium includes high boiling petroleum fractions. The medium is also characterized by excellent thermal stability at sustained operating temperatures of up to 60° F.

An improved lubricating motor oil can also be prepared by adding to a lubricating motor oil about 8 percent by volume of the composition of the present invention prepared by the process of the present invention.

An improved grease composition for treating metal can also be prepared, using about 10–20 parts by volume of the composition of the present invention, about 10–20 parts by volume of silicone oil and about 50–70 parts by volume of carbon black. By silicone oil is meant liquid-organo-polysiloxanes. The carbon black is in finely powdered form, typically about 0.4–10 microns in diameter.

As a specific example of the present improved process of making the improved liquid chemical metal and oil treating composition, 300 ml. of a dispersion comprising 2.5% by volume of $Fe_3O_4$ dispersed in a dispersant comprising a 40% volume concentration of hydrochloric acid in water was mixed with 1000 ml of castor oil and 1000 ml. of ethyl oleate. The resulting mixture was heated to a temperature of 100°–150° F. (this range is due to varying raw material availability and physical characteristics), and then distilled for 30 minutes, after which the residue was recovered. This residue was heated at 100°–150° F. for 1 hr. during which time 100 ml. of powdered polyisobutylene resin dissolved in 1500 ml. of monochlorotoluene was added to the residue along with 6000 ml. of naphthenic petroleum oil, 100 ml. of carbonyl bromide, 100 ml. of N,N' ethylene bisstearamide and 200 ml. of ortho-toluene sulfonate. The mixture was stirred thoroughly in a mixer at 70 rpm until the heated mixture was homogeneous. It was then stored in an open storage tank for 24 hrs. before it was used.

In one test the finished composition (Composition I) was added in 80 ml. concentration to 1 liter of petroleum motor oil and the resulting treated motor oil was then ready for use in an engine. Engine runs using Composition I are set forth below.

In another test 100 ml of Composition I were added with mixing to 200 ml. of silicone oil comprising liquid polysiloxane and 700 ml. of powdered carbon black to form a metal-treating grease.

In the following two examples, Compositions II and III were prepared using the same process as set forth above for the preparation of Composition I, except for the following changes in the materials added during the process in each instance.

COMPOSITION II

| INGREDIENTS ADDED DURING PROCESSING | PERCENT BY VOL. |
|---|---|
| powdered lead oxide (as a dispersion in 40% vol. | 1 |

-continued

| COMPOSITION II | |
|---|---|
| INGREDIENTS ADDED DURING PROCESSING | PERCENT BY VOL. |
| aqueous HCl) | |
| olive oil | 1 |
| magnesium oleate | 0.5 |
| monobromoxylene | 20 |
| monochlorotoluene | 2 |
| nickel carbonyl | 0.5 |
| amide of chloroacetic acid | 0.5 |
| powdered neoprene resin | 25 |
| polybutene | 1 |
| calcium sulfonate | 1 |
| motor oil | remainder |

Composition II performed as well as Composition I. So also did Composition III made by the present process but utilizing the following materials in the process:

| COMPOSITION III | |
|---|---|
| INGREDIENTS ADDED DURING PROCESSING | VOLUME % |
| iron carbide dispersed in a dispersant comprised of 38 vol. % aqueous HCl | 1.5 |
| cashew oil | 1.5 |
| ethyl oleate | 1.5 |
| monofluorobenzene | 15 |
| zinc dialkyl dithiophosphate | 1 |
| carbonyl chloride | 1.5 |
| N,N' ethylene bisstearamide | 1.5 |
| polychloroprene | 25 |
| polyisobutylene | 2 |
| methyl benzene sulfonate | 1.5 |
| naphthenic petroleum oil | remainder |

Experiments involving the use of Composition I are set forth in the Description of Experiment below.

DESCRIPTION OF EXPERIMENT

A Willy's jeep engine directly connected to a dynamometer (a 5-kilowatt DC generator) running at 1800 RPM was used in the experiment. Six experimental runs lasting 9 minutes each were performed. Each run was made at a constant generator load. The load was provided by means of a water rheostat consisting of two electrodes immersed in a concrete tank containing water and salt solution. The generator voltage was kept in the vicinity of 100 to 125 volts in all runs while the line current supplied by the generator to the rheostat was varied from run to run starting at 0 amperes in Run 1 and increased by increments of 9 amperes in succeeding runs. The voltage and current were kept constant in each run to make the generator load constant. Thus, in Runs 2, 3, 4, 5 and 6 the current was maintained constant respectively at 9, 18, 27, 36 and 45 amperes.

The friction horsepower and generator losses were determined after each run by the "cylinder cut-out method". At the end of each run, a cylinder of the engine was cut out one at a time and the speed of the engine brought back to 1800 RPM by reducing the rheostat load. Cutting out one cylinder reduced the power delivered by the engine by an amount equal to the indicated horsepower (IHP), the power developed in that cylinder. The total IHP, therefore, is the sum of the individual indicated horsepower developed in each of the four cylinders. The difference between the total IHP and the power delivered by the generator or the combined horsepower (CHP) is the engine frictional horsepower and generator losses (FHP+GL).

The data obtained are shown in Table I and a summary of calculated results in Table 2 for Runs without the metal treatment composition. Tables 3 and 4 show data and results for Runs with the composition. Table 5 compares the engine operating conditions when there is no composition with those when the composition is added.

The combined specific fuel consumption (CSFC) is calculated by dividing the weight of the fuel consumed (lb) by the time of the run (hour) and the combined horsepower (CHP). Similarly, the indicated specific fuel consumptions (ISFC) is obtained by dividing the fuel consumed by the time and the indicated horsepower (IHP). Thermal efficiency calculations are also shown in the example calculations.

TEST RUN RESULTS

Experiment Summary

The performance of a four-cylinder Willy's jeep engine on a bench dynamometer was measured when 250 milliliters of the metal treatment composition was added to the crank case oil of the engine. The performance was compared to that prior to the addition of the composition with the following results:

1. The friction horsepower and generator losses (FHP4GL) were reduced by 14.8% with a consequent slight improvement in the combined thermal efficiency.
2. The resulting fuel saving due to improved efficiency was 5.6%.

The experimental results are shown graphically in FIGS. 1 to 4. FIG. 1 shows a plot of FHP+GL against CHP (Combined Horsepower) for both cases of with and without the novel present composition. Clearly, friction losses have been shown to be less for the case with the composition in the lubricating oil.

The significant reduction in friction losses of about 15% resulted in significant improvement in thermal efficiency and combined specific fuel consumption improvement as shown in FIGS. 2 and 3. The percentage of fuel saving based on comparison to combined horsepower showed dramatic improvement as load increases. As FIG. 4 indicates, the savings exceed 6% at the end of our limited testing parameters. It is noted, however, that the experiments with the novel present composition were performed in the afternoon when ambient temperature was higher compared to the morning ambient temperature. These conditions are shown in Table 5. The experiments without the novel present composition were performed in the morning. Thus, the engine was operating under slightly adverse conditions for the case with the novel present composition compared to that without the composition.

EXAMPLE CALCULATIONS $$\text{Combined Thermal Efficiency} = \frac{2545 \times 100\%}{CSFC \times GHV}$$

$$\text{Indicated Thermal Efficiency} = \frac{2545 \times 100\%}{ISFC \times GHV}$$

Where *GHV*, Gross Heating Value of Gasoline = 20,250 Btu/lb

For Run 5, Table 1: $CSFC = 1{,}421$ lb/hp/h and
$ISFC = 0.546$ lb/hp/h

-continued
EXAMPLE CALCULATIONS

Therefore, $$\text{Combined Thermal Efficiency} = \frac{2545 \times 100\% = 8.8\%}{1{,}421 \times 20{,}250}$$

$$\text{Indicated Thermal Efficiency} = \frac{2545 \times 100\% = 23.0\%}{0.546 \times 20{,}250}$$

TABLE 1

DATA ON JEEP ENGINE GENERATOR PERFORMANCE TEST

| | RUN NO. (WO/ADD.) | | | | | |
|---|---|---|---|---|---|---|
| | 1 | 2 | 3 | 4 | 5 | 6 |
| LINE VOLTAGE, V | 110.0 | 110.0 | 125.0 | 124.0 | 115.0 | 110.0 |
| LINE CURRENT, I | 0.0 | 9.0 | 18.0 | 27.0 | 36.0 | 45.0 |
| FUEL CONSUMED | | | | | | |
| Grams | 370 | 400 | 450 | 490 | 540 | 545 |
| Time. Minutes | 9.40 | 9.00 | 9.03 | 9.00 | 9.05 | 8.88 |
| CYLINDER CUT-OUT | | | | | | |
| First Cylinder | | | | | | |
| V1 | 0.0 | 45.0 | 55.0 | 60.0 | 65.2 | 65.5 |
| I1 | 0.0 | 3.0 | 7.0 | 12.5 | 20.5 | 28.0 |
| Second Cylinder | | | | | | |
| V2 | 0.0 | 45.0 | 56.0 | 65.0 | 70.2 | 70.0 |
| I2 | 0.0 | 3.5 | 8.0 | 14.0 | 22.0 | 29.0 |
| Third Cylinder | | | | | | |
| V3 | 0.0 | 45.0 | 58.0 | 65.0 | 74.0 | 71.0 |
| I3 | 0.0 | 3.5 | 8.0 | 14.5 | 22.5 | 29.0 |
| Fourth Cylinder | | | | | | |
| V4 | 0.0 | 45.0 | 58.0 | 65.5 | 69.0 | 70.0 |
| I4 | 0.0 | 3.0 | 8.0 | 13.5 | 21.0 | 29.0 |

TABLE 2

SUMMARY OF RESULTS

| | RUN NO. (WO/ADD.) | | | | | |
|---|---|---|---|---|---|---|
| | 1 | 2 | 3 | 4 | 5 | 6 |
| POWER | | (1) | | | | |
| CHP | 0.000 | 1.327 | 3.016 | 4.488 | 5.550 | 6.635 |
| FHP + GL | | 3.197 | 6.688 | 8.790 | 8.613 | 9.245 |
| Average FHP + GL | 8.883 | (for Runs 4 to 6) | | | | |
| IHP | 8.883 | 10.210 | 11.899 | 13.371 | 14.432 | 15.518 |
| BHP | | | | | | |
| S.FUEL CONSUMPTION | Gross Heat Value of Gasoline, Btu/lb | | | | | 20250 |
| Lb/hp/h | | | | | | |
| CSFC | | 4.426 | 2.183 | 1.603 | 1.421 | 1.222 |
| ISFC | 0.586 | 0.575 | 0.553 | 0.538 | 0.546 | 0.522 |
| BSFC | | | | | | |
| THERMAL EFF. % | | | | | | |
| Combined | | 2.8 | 5.8 | 7.8 | 8.8 | 10.3 |
| Indicated | 21.5 | 21.8 | 22.7 | 23.4 | 23.0 | 24.1 |
| Brake | | | | | | |
| ENGINE SPEED, RPM | | | | | | |
| Normal Operation | 1802 | 1797 | 1795 | 1798 | 1815 | 1795 |

TABLE 2-continued

| SUMMARY OF RESULTS | RUN NO. (WO/ADD.) | | | | | |
|---|---|---|---|---|---|---|
| | 1 | 2 | 3 | 4 | 5 | 6 |
| 1 Cylinder Out | | 1556 (1) | 1656 (1) | 1758 | 1781 | 1778 |

(1) FHP + GL for this run was not considered because the engine speed when one cylinder was cut out could not be raised to equal that when all cylinders were firing.

TABLE 3

| DATA ON JEEP ENGINE-GENERATOR PERFORMANCE TEST | RUN NO. (W/ADD.) | | | | | |
|---|---|---|---|---|---|---|
| | 1 | 2 | 3 | 4 | 5 | 6 |
| LINE VOLTAGE, V | 110.0 | 95.5 | 115.0 | 110.0 | 105.5 | 99.0 |
| LINE CURRENT, I | 0.0 | 9.0 | 18.0. | 27.0 | 36.0 | 45.0 |
| FUEL CONSUMED | | | | | | |
| Grams | 330 | 390 | 420 | 465 | 495 | 540 |
| Time, Minutes | 9.12 | 9.48 | 8.87. | 9.07 | 8.97 | 9.13 |
| CYLINDER CUT-OUT | | | | | | |
| First Cylinder | | | | | | |
| V1 | 0.0 | 35.0 | 47.0 | 53.0 | 55.0 | 60.0 |
| I1 | 0.0 | 3.0 | 7.0 | 13.1 | 21.0 | 28.0 |
| Second Cylinder | | | | | | |
| V2 | 0.0 | 37.0 | 50.0 | 60.0 | 55.0 | 65.0 |
| I2 | 0.0 | 3.0 | 8.0 | 15.0 | 22.5 | 30.0 |
| Third Cylinder | | | | | | |
| V3 | 0.0 | 37.0 | 51.0 | 62.0 | 65.0 | 65.0 |
| I3 | 0.0 | 3.0 | 8.1 | 15.0 | 23.0 | 30.0 |
| Fourth Cylinder | | | | | | |
| V4 | 0.0 | 35.0 | 50.0 | 55.0 | 62.0 | 64.0 |
| I4 | 0.0 | 3.0 | 7.7 | 13.5 | 22.0 | 29.0 |

AVERAGE FUEL SAVINGS (GRAMS) FROM 466 T 440 = 5.6%

TABLE 4

| SUMMARY OF RESULTS | RUN NO. (W/ADD.) | | | | | |
|---|---|---|---|---|---|---|
| | 1 | 2 | 3 | 4 | 5 | 6 |
| POWER | | (1) | | | | |
| CHP | 0.000 | 1.152 | 2.775 | 3.981 | 5.091 | 5.972 |
| FHP + GL | | 2.877 | 6.277 | 7.565 | 8.234 | 7.948 |
| Average FHP + GL | 7.506 | (for Runs 3 to 6) | | | | |
| IHP | 7.506 | 8.658 | 10.281 | 11.487 | 12.597 | 13.478 |
| BHP | | | | | | |
| S.FUEL CONSUMPTION | Gross Heat Value of Gasoline, Btu/lb | | | | | 20250 |
| Lb/hp/h | | | | | | |
| CSFC | | 4.717 | 2.256 | 1.702 | 1.433 | 1.308 |
| ISFC | 0.637 | 0.628 | 0.609 | 0.590 | 0.579 | 0.580 |
| BSFC | | | | | | |
| THERMAL EFF. % | | | | | | |
| Combined | | 2.7 | 5.6 | 7.4 | 8.8 | 9.6 |
| Indicated | 19.7 | 20.0 | 20.6 | 21.3 | 21.7 | 21.7 |
| Brake | | | | | | |
| ENGINE SPEED, RPM | | | | | | |
| Normal Operation | 1791 | 1802 | 1797 | 1794 | 1795 | 1790 |
| 1 Cylinder Out | | 1556 (1) | 1729 | 1750 | 1782 | 1789 |

TABLE 4-continued

| SUMMARY OF RESULTS | | | | | | |
|---|---|---|---|---|---|---|
| | RUN NO. (W/ADD.) | | | | | |
| | 1 | 2 | 3 | 4 | 5 | 6 |

AVERAGE REDUCTION IN FHP + GL (from 8.8 to 7.5) = 14.8%
AVERAGE FUEL SAVING BASED ON CSFC (FROM 2.16 TO 1.90) = 12.0%
(1) FHP + GL for this run was not considered because the engine speed when one cylinder was cut out could not be raised to equal that when all cylinders were firing.

TABLE 5

| OPERATING ENGINE PARAMETERS AT 1800 RPM | | | | | | |
|---|---|---|---|---|---|---|
| | OPERATING TEMPERATURES, DEGREES C. | | | | OIL PRES. | |
| | Ambient | Air In | Exhaust | H2O | VACUUM | |
| RUN NO. | 1 | 2 | 3 | 4 | 5 | 6 |
| 1 W/Add. | 31.0 | 37.0 | 198.5 | 64.3 | 17.0 | 20.0 |
| 1 Without | 29.0 | 33.0 | 196.7 | 54.0 | 20.0 | 19.7 |
| 2 W/Add. | 31.0 | 37.0 | 206.5 | 63.0 | 15.0 | 19.0 |
| 2 Without | 29.0 | 33.5 | 206.7 | 56.3 | 15.0 | 18.5 |
| 3 W/Add. | 32.0 | 37.3 | 221.8 | 66.0 | 15.0 | 17.5 |
| 3 Without | 29.0 | 34.0 | 226.5 | 58.8 | 15.0 | 17.0 |
| 4 W/Add. | 32.0 | 36.3 | 237.8 | 67.8 | 15.0 | 16.0 |
| 4 Without | 39.0 | 34.3 | 241.0 | 60.8 | 15.0 | 16.0 |
| 5 W/Add. | 32.0 | 38.0 | 249.8 | 70.3 | 15.0 | 15.0 |
| 5 Without | 30.0 | 34.8 | 253.8 | 62.0 | 15.0 | 14.5 |
| 6 W/Add. | 32.0 | 38.0 | 257.0 | 71.3 | 15.0 | 14.0 |
| 6 Without | 31.0 | 35.0 | 262.0 | 63.0 | 15.0 | 13.5 |

THE RESULT OF TESTING THE COMPOSITION OF THE PRESENT INVENTION IN A MINING OPERATION IS AS FOLLOWS

1. Test Equipment: EUCLID R-85. Dump truck 211 with 850 HP Cummins engine and 85 tons capacity.
2. Duration of Test: 1,089.10 operating running hours.
3. Test Results:
   a. Lubricant treated with the present composition I in a concentration of about 8% by vol. in motor oil was found still fit for further use after. 1,089.1 operating running hours. Normally, a complete oil change when conventional lubricating oil is used, must be made after 250 running hours, due mainly to water-fuel dilution, accumulated metal particles, sludge, altered viscosity, low total base number (TBN) and low flash point. If any of the above factors had gone below specified standards, the oil would have had to be drained and changed.
   b. The 31-day fuel consumption immediately prior to the test was 24,871 liters. The Comparable 31-day test period recorded a fuel consumption of 17,507 liters. This resulted in a savings of 7,364 liters over a 31-day period or 29.6%.
   c. Life of the engine oil was extended 4.36 times as tested. However, laboratory recommendations allowed further use of the oil.
   d. No significant water dilution was noted in the assay.
   e. Reduction of iron filings/particles to 140.4 ppm from 254.8 ppm. was noted.
   f. Engine testing prior to adding the metal treatment composition revealed abnormally worn mating surfaces. This resulted in loss of compression and reduced rate of acceleration. High fuel and oil consumption were also evident. The engine in question was normally overhauled every six months or 7000 running hours due to the above mentioned abnormal wear and tear, i.e., worn piston and oil rings and cylinder walls.

After adding the composition (and before another overhaul) testing showed no signs of existing deterioration in terms of blow-by and loss of compression.

THE TEST RESULTS OF THE COMPOSITION OF THE PRESENT INVENTION IN AN INDUSTRIAL MANUFACTURING OPERATION ARE AS FOLLOWS

On the 50 HP grinders, (7 units)

a. Amperage reduced from 22 to 20 AMP. (with load);
b. There was a noticeable increase in rpm;
c. Noise and vibration level were reduced;
d. Before the use of the present composition I in the lubricating oil in a concentration of about 8% vol. 145 MT/day (metric tons) coconut oil output required maximum capacity of all 7 of the grinders. After use of the novel composition in the lubricating oil, 165 MT output required only 6 grinders.

Savings: 1 grinder (50 HP)=NOW IDLE $500.00/week (in terms of electric consumption (Spare–less wear & tear)

Therefore: per ton coconut oil—

Before: 145 MT/7 Grinders=20/7 MT/grinder

After: 165 MT/6 Grinders=27.5 MT/grinder

Therefore: Savings in terms of percentage 27.5–20.7=6.8 MT or 33% increase in production And 1] Additional savings on electricity and spare parts,
2] Less maintenance and downtime costs,
3] More efficient operations requiring less direct supervision and reduced indirect labor due to reduced downtime.

APPLICATION OF THE INVENTION IN GREASE FORM

Composition I (20% by volume) was mixed with 10% by vol. of silicone oil and 70% by vol. of carbon black (average particle size 5 microns) to form a grease. Numerous tests run disclosed that without the application of the grease, the engine torque that could be withstood was not more than 100 inch pound in load.

The tester was equipped with a meter that indicated the in-put power of the drive motor. Without the use of the grease at 100 inch pounds load the motor tripped or stopped at a maximum of 10 amperes. With the use of the grease the amperage remained at no load current rating even when the load was more than 1000 inch pounds or an increase of power by a factor of 10 times.

The foregoing description is just an illustration of the present invention and should not be construed as a limitation thereof.

What is claimed is:

1. A process of preparing a lubricating motor oil concentrate, said process comprising:

A) mixing together:

i. ingredient A which comprises material selected from the group consisting of powdered ferric chloride, lead oxide, ferric oxide, iron carbide, chromium carbide and tungsten carbide and mixtures thereof, wherein said chloride oxides and carbides are dispersed in an aqueous solution of acid selected from the group consisting of hydrochloric acid, perchloric acid and sulfuric acid;

ii. vegetable oil; and, iii. oleate selected from the group consisting of magnesium oleate, ethyl oleate and mixtures thereof;

B) heating the resultant mixture with stirring to a temperature of at least about 100° F.;

C) distilling the heated mixture and recovering the non-distilled residue; and,

D) subjecting said residue to stirring and heating at about 100°–150° F. while adding thereto an antioxidant, a polar hydrocarbon, a carbonyl, a carboxyl amide, a viscosity improver, at least one of a tackifier and a sulfonate, and a petroleum oil wherein a homogeneous liquid is obtained.

2. The process of claim 1 wherein said materials have the following approximate proportions:

| MATERIALS | PERCENT BY VOLUME OF COMPOSITION |
|---|---|
| Ingredient A | 0.5–1.5 |
| Vegetable Oil | 0.5–1.5 |
| Oleate | 0.5–1.5 |
| Polar Hydrocarbon | 10.0–20.0 |
| Antioxidant | 0.5–2.0 |
| Carbonyl | 0.2–1.0 |
| Carboxyl Amide | 0.2–1.0 |
| Viscosity Improver | 25.0–40.0 |
| Tackifier | 0.5–2.0 |
| Sulfonate | 0.5–3.0 |
| Petroleum Oil | 40.0–60.0 |

3. The process of claim 2 wherein said vegetable oil is selected from the group consisting of castor oil, cashew oil, olive oil and mixtures thereof, wherein said polar hydrocarbon is selected from the group consisting of chlorine-substituted hydrocarbon, bromine-substituted hydrocarbon, fluorine-substituted hydrocarbon and mixtures thereof, wherein said antioxidant is selected from the group consisting of zinc dialkyl dithiophosphate, monochlorotoluene, nonyl phenol disulfide, 2-6-di-tert-butyl-dimethylamino-p-cresol, 2,2' ethylidene Bis (4,6-di-t-butyl phenyl) fluorophosphonite, 1,2,5-trimethyl 2-4-6 tris-(3,5)di-tert-butyl-4 hydroxybenzyl) benezene, 4,4 methylenebis (2,6 di-tert butylphenol) and mixtures thereof, and wherein said carbonyl is selected from the group consisting of manganese carbonyl, carbonyl bromide, carbonyl fluoride, carbonyl sulfide and mixtures thereof.

4. The process of claim 3 wherein said carboxyl amide is selected from the group consisting of N,N' ethylene bisoleamide, N,N' ethylene bisstearamide, amide of benzoic acid, amide of allcyclic acid, amide of chloroacetic acid, amide of salicylic acid and mixtures thereof, wherein said viscosity improver is selected from the group consisting of an alkyl ester, polyisobutylene, olefin copolymer, neoprene resin, polychloroprene and mixtures thereof, wherein said tackifier is polybutene wherein said sulfonate is selected from the group consisting of magnesium sulfonate, calcium sulfonate, alkyl benezene sulfonate and mixtures thereof and wherein said petroleum oil is selected from the group consisting of naphthenic oil, heat transfer oil and mixtures thereof.

5. The concentrate prepared by the process of claim 1.

6. The concentrate prepared by the process of claim 2.

7. The concentrate prepared by the process of claim 3.

8. The concentrate prepared by the process of claim 4.

9. A lubricating motor oil, said lubricating motor oil containing about 8 percent by volume of the concentrate of claim 5.

10. A lubricating motor oil, said lubricating motor oil containing about 8 percent by volume of the concentrate of claim 8.

11. A grease composition for treating metal, said grease composition comprising about 10–20 parts by volume of the concentrate of claim 5, about 10–20 parts by volume of silicone oil and about 50–70 parts by volume of carbon black.

* * * * *